US008142091B2

(12) United States Patent
Sano

(10) Patent No.: US 8,142,091 B2
(45) Date of Patent: Mar. 27, 2012

(54) WRITING IMPLEMENT

(75) Inventor: Yojiro Sano, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 546 days.

(21) Appl. No.: 12/289,712

(22) Filed: Oct. 31, 2008

(65) Prior Publication Data

US 2009/0142120 A1 Jun. 4, 2009

(30) Foreign Application Priority Data

Nov. 1, 2007 (JP) ..... 2007-285089

(51) Int. Cl.
*A46B 5/02* (2006.01)

(52) U.S. Cl. ..... 401/6; 401/109

(58) Field of Classification Search ..... 401/6, 109–114, 401/116

See application file for complete search history.

(56) References Cited

U.S. PATENT DOCUMENTS

D286,650 S * 11/1986 Fischer ..... D19/55
H1050 H * 5/1992 Petrillo ..... 401/6
5,997,200 A * 12/1999 Kageyama et al. ..... 401/6
6,146,038 A * 11/2000 Mittersinker et al. ..... 401/6
6,902,334 B1 * 6/2005 Kung ..... 401/109
7,794,164 B2 * 9/2010 Kobayashi et al. ..... 401/88
7,883,754 B2 * 2/2011 Qiu et al. ..... 428/35.7

* cited by examiner

*Primary Examiner* — Christopher Kim
(74) *Attorney, Agent, or Firm* — Kubovcik & Kubovcik

(57) ABSTRACT

A writing implement capable of eliminating troubles associated with the adoption of a grip member having an end surface inclined from a vertical surface perpendicular to a central axis of a shaft tube. The inclination angle α of a step-facing surface 5A of the grip member 5 is made smaller than the inclination angle β of an inclined step surface 12 of the shaft tube 10. A gap G is partially formed between the step-facing surface 5A and the inclined step surface 12 when a compressive force is not applied to the grip member 5. When the grip member 5 is compressed, the whole of the step-facing surface 5A is further inclined and comes into contact with the inclined step surface 12. Accordingly, even when the step-facing surface 5A of the grip member 5 is inclined for imparting excellent design to the writing implement, an acute-angled tip-end portion of the grip member 5 is prevented from moving along the inclined step surface 12 and rising from the surface of the shaft tube 10, thereby preventing the occurrence of the troubles.

4 Claims, 4 Drawing Sheets

WRITING IMPLEMENT

BACKGROUND OF THE INVENTION

1. Field of the Invention

The present invention relates to a writing implement provided with a shaft tube formed in a cylindrical shape, in which a part at an end of the shaft tube that most of the users grip is formed as a reduced-diameter portion with a diameter smaller than an outside diameter of the remaining part, and in which a cylindrical grip member made flexible elastic material is fitted to the reduced-diameter portion.

2. Description of the Related Art

There has been conventionally used a writing implement fitted with a flexible grip member in the vicinity of a tip end of its shaft tube where a user is likely to hold lest a grip should slip or hurt the user's fingers when being used to write for a long time, More specifically, a tip-end part of a shaft tube of a writing implement formed in a cylindrical shape has a reduced diameter, which is referred to as a reduced-diameter portion. The reduced-diameter portion of the shaft tube is covered with a grip member which is formed in a cylindrical shape having an inside diameter corresponding to the reduced-diameter portion.

As materials for the grip member, in general, flexible materials such as rubbers, e.g., silicone rubber, EPDM (ethylene-proplylene-diene rubber) and NBR (acrylonitrile-butadiene rubber), thermoplastic elastomers, etc. are used.

As the grip member, there are known those in which an end surface located in the middle-part side of the shaft tube is so formed as to be inclined with respect to a central axis of the shaft tube, that is, so as to be inclined from a vertical surface perpendicular to the central axis. If such a grip member is provided in the writing implement, it is possible to mitigate the pain in the fingers caused by writing for a long time due to the flexibility of the grip member and, in addition, it is possible to impart excellent design to the writing implement due to the inclined end surface.

In a writing implement provided with a grip member as described above, a tip member formed in a substantially conical shape is usually screwed to a tip-end portion of its shaft tube. In such a shaft tube, a step is formed at the boundary between a portion having a larger diameter than the reduced-diameter portion and the reduced-diameter portion. As a result, it is ensured that the grip member fitted to the reduced-diameter portion is supported by being interposed between the step of the shaft tube and the tip member.

If the whole length of the grip member is larger than the whole length of the reduced-diameter portion, then the grip member supported by being interposed between the step and the tip member is compressed by strongly fastening the tip member screwed to the shaft tube. Then, the grip member and the tip member engage frictionally with each other, and, as a result, the grip member prevents the tip member screwed to the shaft tube from rotating. Therefore, the screwed tip member does not become loose due to vibrations or the like, and it is possible to prevent troubles, such as unexpected disengagement of the tip member from the shaft tube during transfer (cf. JP 2007-253548 A).

In a writing implement as described above, in order to improve the appearance in terms of designing, a grip member whose end surface is inclined with respect to the central axis of the shaft tube (i.e., a grip member having an end surface inclined from a vertical surface perpendicular to the central axis) is adopted, then also a step surface formed at the boundary of the reduced-diameter portion provided in the shaft tube is so inclined as to correspond to the inclined end surface of the grip member.

The grip member, while disposed between the step surface of the shaft tube and the tip member, is supported by being interposed between the step surface of the shaft tube and the tip member by fastening the tip member screwed to the tip end of the shaft tube. As a result, the grip member is fixed in a compressed condition.

In a case where the step surface is inclined as described above, while fastening the tip member screwed to the tip end of the shaft tube, the inclined grip member cannot engage the tip end of the acute-angled end surface of the grip member and therefore, due to the fastening of the tip member, the tip end of the acute-angled end surface of the grip member moves along the inclined step surface and rises from the surface of the shaft tube. Due to the mounting of the grip member, therefore, contrarily troubles as described below occur. That is, the appearance of the writing implement is impaired and, besides, the end portion of the grip member becomes turned up and hence becomes apt to be damaged.

Thus, each aspect of the present invention was incorporated in the invention in view of the problems with the related art, and the object of the invention is to provide a writing implement capable of eliminating troubles caused by the adoption of a grip member having an end surface inclined from a vertical surface perpendicular to a central axis of a shaft tube.

SUMMARY OF THE INVENTION

Each of the aspects incorporated in the present invention is intended for achieving the above-described object. Features of the aspects will be described below.

First Aspect

Feature

A first aspect of the present invention provides a writing implement comprising:

a shaft tube formed in a cylindrical shape, a reduced-diameter portion which is formed at an end of the shaft tube and has an outside diameter smaller than that of a remaining part of the shaft tube, and a cylindrical grip member made of flexible elastic material fitted to the reduced-diameter portion from the end of the shaft tube;

the shaft tube having a step so formed as to correspond to an end of the grip member, the step having a step surface opposing to the end of the grip member, the step surface being so formed as to be inclined against a vertical surface perpendicular to a central axis of the shaft tube, the grip member having a step-facing surface opposing to the step surface, the step-facing surface being so formed as to be inclined against the vertical surface perpendicular to the central axis of the shaft tube, and an inclination angle formed between the step-facing surface of the grip member and the vertical surface being smaller than that formed between the step surface of the shaft tube and the vertical surface.

Second Aspect

Feature

A second aspect of the present invention provides a writing implement, in addition to the feature of the first aspect of the present invention shown above, further comprising:

a tip member covering an opening at the end of the shaft tube, a shaft-tube screw portion formed at the end of the shaft tube, a tip-member screw portion formed in the tip member;

the tip-member screw portion being so formed as to be screwed to the shaft-tube screw portion, the tip member being attached to the end of the shaft tube by the tip-member screw portion being screwed to shaft-tube screw portion, the grip member having a longest region and a shortest region along the axis of the shaft tube caused by the inclination of the step-facing surface, the reduced-diameter portion having a longest region and a shortest region along the axis of the shaft tube caused by the inclination of the step surface and also having a longest covered portion defined as a part of the longest region other than the shaft-tube screw portion and a shortest covered portion defined as a part of the shortest region other than the shaft-tube screw portion caused by the inclination of the step surface, the longest region of the grip member being almost as long as the longest covered portion of the reduced-diameter portion, the shortest region of the grip member being longer than the shortest covered portion of the reduced-diameter portion, the grip member being disposed between the step-surface of the reduced-diameter portion and the tip member, and the shortest region of the grip member being compressed along the axis of the shaft tube when the tip member is screwed to the end of the shaft tube.

Third Aspect

Feature

A third aspect of the present invention provides a writing implement, in addition to the feature of the second aspect of the present invention shown above, the grip member being so formed to have a gap as a compressible space between an end of its longest region and the step surface of the reduced-diameter portion when the grip member is fitted to the reduced-diameter portion not being compressed along the axis of the shaft tube, and the end of the longest region of the grip member touching the step surface of the reduced-diameter portion when the tip member is fully screwed to the end of the shaft tube.

Fourth Aspect

Feature

A fourth aspect of the present invention provides a writing implement, in addition to the feature of the third aspect of the present invention shown above, the reduced-diameter portion having a first reduced-diameter portion and a second reduced-diameter portion with different outside diameters from each other, the first reduced-diameter portion provided at a far end from the tip portion being formed thinner than the second reduced-diameter portion at another end, a step surface formed a step in a boundary between the first reduced-diameter portion and the second reduced-diameter portion being a cone-shaped step surface formed in a shape of a circular truncated cone coaxial with the central axis of the shaft tube, and the grip member having a cone-shaped step surface formed in its inner surface corresponding to the cone-shaped step surface of the reduced-diameter portion by the inner surface being reduced correspondingly to the reduced-diameter portion.

The present invention constituted as described above produces advantages as described below.

Advantages of the First Aspect

According to the first aspect of the present invention, the step-facing surface of the grip member is inclined and the step surface of the shaft tube opposed to the inclined step-facing surface of this grip member is also inclined. Thus, on the surface of the shaft tube, a boundary line between the grip member and the shaft tube extends obliquely with respect to the central axis of the shaft tube. As a result, excellent design can be imparted to the writing implement.

Moreover, the inclination angle of the step-facing surface of the grip member, more specifically the angle between the step-facing surface and a vertical surface perpendicular to the central axis of the shaft tube, is made smaller than the inclination angle between the step surface of the shaft tube and the vertical surface. Thus, the whole of the acute-angled step-facing surface of the grip member does not come into contact with the inclined step surface when a compressive force is not applied to the grip member fitted to the reduced-diameter portion of the shaft tube. In other words, in this condition, a gap is partially formed between the step-facing surface and the step surface. More specifically, a gap is formed between the acute-angled tip-end portion of the grip member and the step surface.

Further, the grip member is usually applied a compressive force along the axial direction after being completely incorporated to the shaft tube in order to improve the grasping feeling of the shaft tube during use. Due to this compressive force, the step-facing surface of the grip member is depressed toward the inclined step surface after the grip member being completely incorporated to the shaft tube, and the whole of step-facing surface comes into contact with the step surface. Therefore, the gap formed between the acute-angled tip-end portion of the grip member and the step surface disappears, and the boundary line formed by the two members of different materials that constitute each of the grip member and the shaft tube extends obliquely. Thus, excellent design can be imparted to the writing implement.

Moreover, the whole of the step-facing surface of the grip member comes into contact with the inclined step surface due to the compression of the grip member after being incorporated to the shaft tube. Thus, even when the step-facing surface of the grip member is inclined, the acute-angled tip-end portion of the grip member, not moving along the step surface, does not rise from the surface of the shaft tube. Accordingly, the problem can be solved that the tip-end portion of the grip member becomes turned up to be damaged.

Therefore, excellent design can be imparted to the writing implement due to the grip member having an end surface inclined from a vertical surface perpendicular to the central axis of the shaft tube. In addition, the tip-end portion of the grip member does not become turned up, and the grip member, not being turned up, cannot be damaged. Accordingly, even when the grip member having an inclined end surface is adopted, the problems caused by the adoption of the grip member can be solved. As a result of the foregoing, the above-described object can be achieved.

Advantages of the Second Aspect

The second aspect of the present invention produces advantages as described below in addition to the above-described advantages of the first aspect of the present invention.

According to the second aspect of the present invention, the grip member is disposed between the step surface of the reduced-diameter portion and the tip member, and the shaft tube having an end to which the tip member is screwed is adopted. Thus, when the tip member is screwed to the shaft tube, the tip member moves toward the grip member. Accordingly, as the tip member is screwed to shaft tube, a compressive force along the axial direction of the shaft tube comes to be automatically applied to at least the shortest region of the grip member.

Therefore, until the tip member is screwed to the shaft tube to a certain degree, the longest region of the grip member, i.e., the acute-angled tip-end portion of the grip member, does not come into contact with the step surface of the shaft tube. Accordingly, as the tip member is screwed to shaft tube, a compressive force can be applied not to the longest region but to the shortest region of the grip member.

Further, because a compressive force is applied to the shortest region of the grip member, the grip member prevents the tip member screwed to the shaft tube from rotating. Thus, even when the grip member having the inclined end surface is adopted, the screwed tip member does not become loose due to vibrations or the like. Accordingly, it is possible to prevent troubles, such as unexpected disengagement of the tip member. Moreover, a compressive force is not applied to the acute-angled tip-end portion of the grip member, and the tip-end portion is not strongly pushed against the step surface of the shaft tube even when the compressive force is applied to the tip-end portion. Also in this respect, it is possible to previously prevent troubles such that the grip member is apt to be broken.

Advantages of the Third Aspect

The third aspect of the present invention produces advantages as described below in addition to the above-described advantages of the second aspect of the present invention.

According to the third aspect of the present invention, the grip member is formed in such a manner that, when fitted to the reduced-diameter portion in a non-compressed condition in which the grip member is not compressed along the axial direction of the shaft tube, a gap as a compressible space is generated between the end of the longest region and the step surface of the reduced-diameter portion. Therefore, when the tip member is fully screwed to the end of the shaft tube, the end of the longest region of the grip member and the step surface of the reduced-diameter portion come into contact with each other. Accordingly, that the gap formed between the acute-angled tip-end portion of the grip member and the step surface comes to be surely eliminated. In addition, it becomes possible to surely prevent the phenomenon that the acute-angled tip-end portion of the grip member moves along the step surface and rises from the surface of the shaft tube. Also in this respect, even when the grip member having the inclined end surface is adopted for imparting excellent design to the writing implement, it is possible to surely eliminate the troubles caused by the adoption of this grip member.

Advantages of the Fourth Aspect

The fourth aspect of the present invention produces advantages as described below in addition to the above-described advantages of the third aspect of the present invention.

According to the fourth aspect of the present invention, a step is formed in the reduced-diameter portion by providing a first reduced-diameter portion and a second reduced-diameter portion whose outside diameters are different from each other, a step surface at a boundary part between the first reduced-diameter portion and the second reduced-diameter portion is a cone-shaped step surface, a step corresponding to the reduced-diameter portion is formed on an inner surface of the grip member, and the step surface formed in the step is a cone-shaped step surface corresponding to the cone-shaped step surface of the reduced-diameter portion. Thus the grip member, when compressed, can receive a depressing force with the cone-shaped step surface. Accordingly, the depressing force that depresses the grip member toward the tip member is not concentrated on the end of the shortest region on the inclined step surface, and the grip member is prevented from being applied a concentrated large force. Also in this respect, even when the grip member having the inclined step-facing surface is adopted, it is possible to previously prevent troubles such that the grip member is apt to be broken.

Moreover, the cone-shaped step surfaces that are formed in the shape of a circular truncated cone and correspond to each other are adopted both as the step surface in the boundary part between the first reduced-diameter portion and the second reduced-diameter portion, and as the step surface formed on the inner surface of the grip member. Thus, when the large depressing force that depresses the grip member toward the inclined step surface of the shaft tube is applied to the grip member, the cone-shaped step surface of the grip member is guided to the cone-shaped step surface of the reduced-diameter portion. Subsequently, in the part where the cone-shaped step surface is formed, deformation occurs in such a manner that the grip member spreads in the radial direction. According, it is possible to relieve this depressing force in the radial direction of the grip member. Therefore, also in this respect, the depressing force that depresses the grip member toward the tip member is not concentrated to the end of the inclined step surface of the shortest region, and the grip member is prevented from being applied a concentrated large force. Even when the grip member having the inclined end surface is adopted, it is possible to previously prevent troubles such that the grip member is apt to be broken.

DETAILED DESCRIPTION OF THE PREFERRED EMBODIMENTS

A preferred embodiment for carrying out the invention will be described below on the basis of the drawings.

Figure 1:
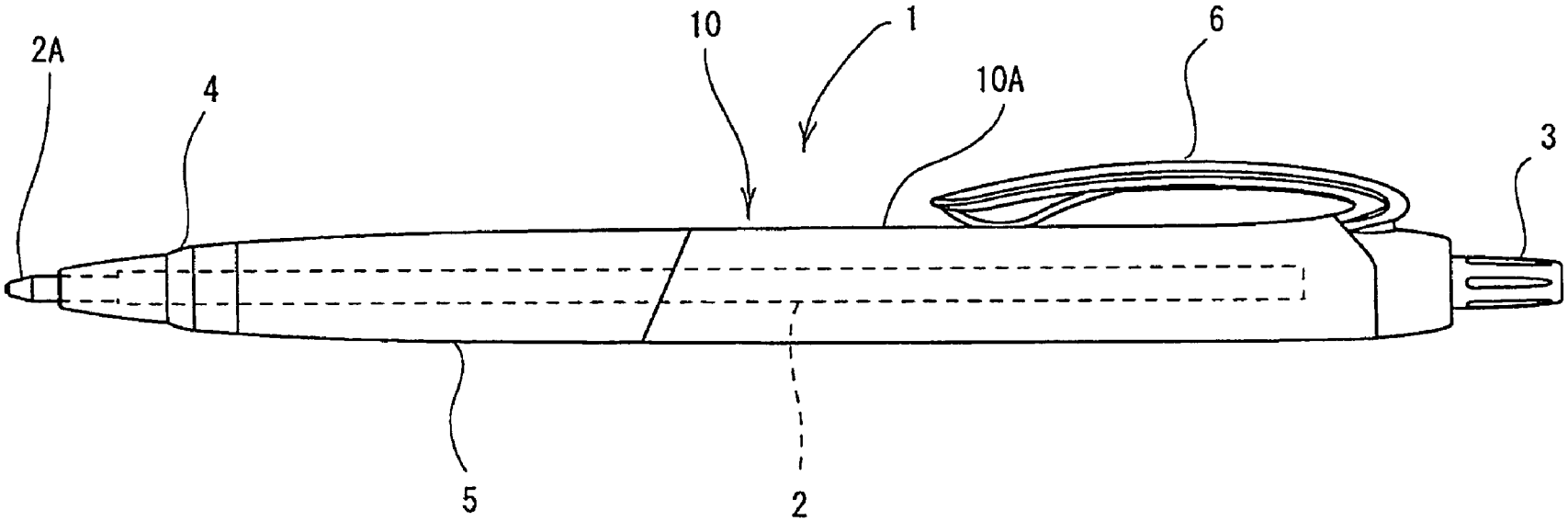
FIG. 1 is a side view showing a writing implement related to an embodiment of the present invention.
Figure 2:
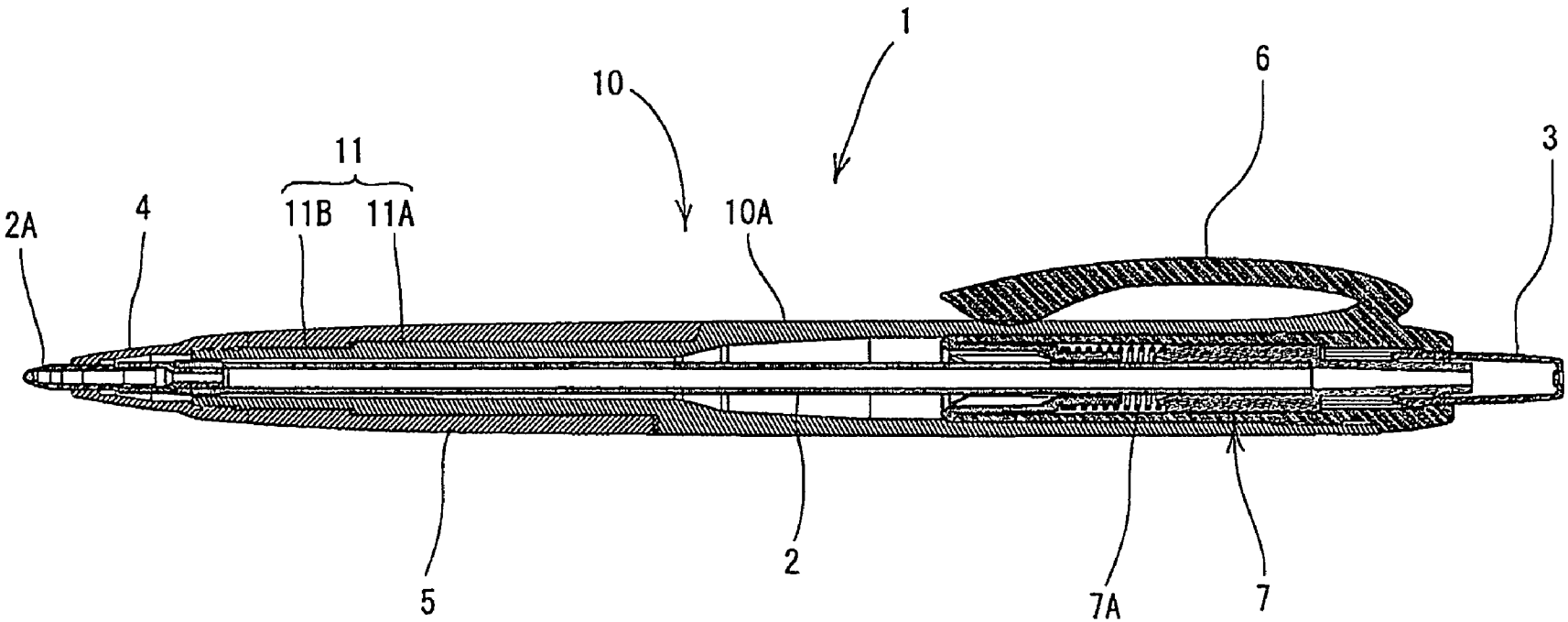
FIG. 2 is a sectional view showing the writing implement related to the embodiment.

As shown in FIGS. 1 and 2, a writing implement 1 related to the embodiment is a retractable ballpoint pen in which a built-in refill 2 is so supported as to be movable axially. When a pushbutton 3 provided at a tail end of the writing implement 1 is pushed, a writing tip 2A of the refill 2 extends out of the interior.

That is, the writing implement 1 is provided, in addition to the refill 2 and the pushbutton 3, with a cylindrical shaft tube 10 for housing the refill 2 inside, a tip member 4 formed in a substantially conical shape screwed to a tip end of the shaft tube 10, and a cylindrical grip member 5 disposed near the tip end of the shaft tube 10 that the user can grip easily.

The shaft tube 10 has a clip member 6 integrated at its tail end for clipping an edge of a pocket of the user's clothes when the writing implement 1 is inserted into the pocket.

In the interior of the tail end of the shaft tube 10 is housed a retraction mechanism 7 that causes a writing tip 2A of the refill 2 to protrude and to retract as shown in FIG. 2. Once the writing tip 2A of the refill 2 is pushed out by the pushbutton 3 being depressed, the retraction mechanism 7 maintains this state of the writing tip 2A being pushed out until the pushbutton 3 is depressed again. When the pushbutton 3 is depressed in the state, the retraction mechanism 7 causes the writing tip 2A of the refill 2 to move backward and to be retracted into the interior of the shaft tube 10.

Further, this retraction mechanism 7 has a coil spring 7A for urging the refill 2 toward the tail end, a rotating cam (not shown) urged by the coil spring 7A toward the tail end, a cam-groove (not shown) formed on an inner wall of the shaft tube 10, etc.

Figure 3A:
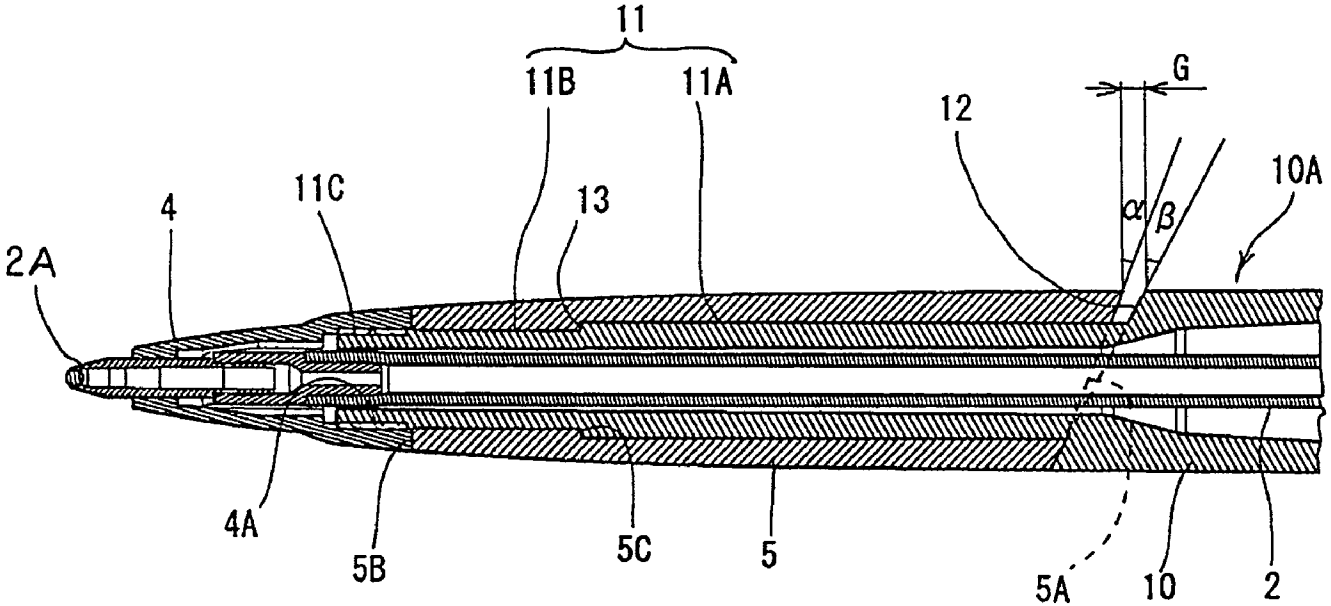
FIGS. 3(A) and 3(B) are enlarged sectional views showing main parts of the embodiment.
Figure 3B:
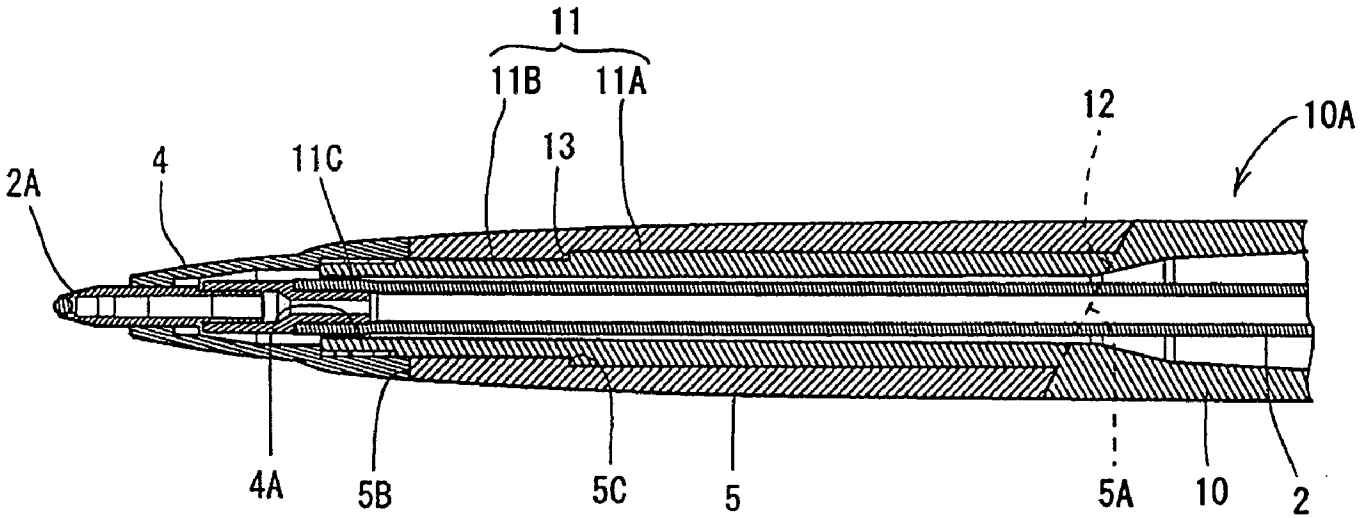

As shown in FIG. 2 and FIGS. 3(A) and 3(B), the shaft tube 10 has a tail-end portion 10A as its rear half and a reduced-diameter portion 11 as its front half with an outside diameter smaller than that of the tail-end portion 10A. Then, the cylindrical grip member 5, which is made of a flexible elastic material such as a thermoplastic elastomer with its tail end surface being inclined, is formed to cover the reduced-diameter portion 11 by being fitted from the tip end of the shaft tube 10.

The reduced-diameter portion 11 is reduced in its diameter in two steps, and has a first reduced-diameter portion 11A as a rear half and a second reduced-diameter portion 11B as a front half that is thinner than the first reduced-diameter portion 11A.

Around an outer circumferential surface of a part of the second reduced-diameter portion 11B in the vicinity of its tip end is formed a male screw groove, which is referred to as a shaft-tube screw portion 11C.

On the other hand, the tip member 4 has an open bottom and a screw groove on its inner circumferential surface. Thus, the tip member 4 has a tip-member screw portion 4A as a female screw that screws together with the shaft-tube screw portion 11C of the second reduced-diameter portion 11B. The tip member 4 is attached to the shaft tube 10 by the tip-member screw portion 4A being screwed to the shaft-tube screw portion 11C of the second reduced-diameter portion 11B.

By the reduced-diameter portion 11 thus being reduced in its diameter in two steps, the shaft tube 10 has step surfaces 12, 13, which form steps both in a boundary part between the tail-end portion 10A and the first reduced-diameter portion 11A and in a boundary part between the first reduced-diameter portion 11A and the second reduced-diameter portion 11B, respectively.

The step surface 12 that forms a step in the boundary part between the tail-end portion 10A and the first reduced-diameter portion 11A is referred to as an inclined step surface 12 inclined from the vertical surface perpendicular to the central axis of the shaft tube 10.

On the other hand, the step surface 13 that forms a step in the boundary part between the first reduced-diameter portion 11A and the second reduced-diameter portion 11B is referred to as a cone-shaped step surface 13 formed in a shape of a circular truncated cone coaxial with the central axis of the shaft tube 10.

The grip member has a step-facing surface 5A that is an end surface opposed to the inclined step surface 12 of the shaft tube 10 and is inclined from the vertical surface perpendicular to the central axis of the shaft tube 10.

On the other hand, a tip-facing surface 5B on the opposite side from the step-facing surface 5A in the grip member 5 provides a vertical surface perpendicular to the central axis of the shaft tube 10.

The inner diameter of the inner circumferential surface of the grip member 5 is reduced corresponding to the first reduced-diameter portion 11A and second reduced-diameter portion 11B of the shaft tube 10. Thus, a step is made on the inner circumferential surface of the grip member 5, which corresponds to the reduced-diameter portion 11 with a step at its halfway.

In other words, on the inner surface of the grip member 5 is formed a cone-shaped step surface 5C formed in the shape of a circular truncated cone coaxial with the central axis of the shaft tube 10 so as to correspond to the cone-shaped step surface 13 of the shaft tube 10.

FIG. 3(A) is an enlarged sectional view showing a state in which the tip-member screw portion 4A of the tip member 4 is screwed halfway to the shaft-tube screw portion 11C of the shaft tube 10 and hence a compressive force along the axial direction of the shaft tube 10 is not applied to the grip member 5. FIG. 3(B) is an enlarged sectional view showing a state in which the tip-member screw portion 4A of the tip member 4 is fully screwed to the shaft-tube screw portion 11C of the shaft tube 10 and hence a compressive force along the axial direction of the shaft tube 10 is applied to the grip member 5.

As shown in FIG. 3(A), the step-facing surface 5A of the grip member 5 forms an inclination angle $\alpha$ with respect to a vertical surface perpendicular to the central axis of the shaft tube 10, whereas the inclined step surface 12 of the shaft tube 10 forms an inclination angle $\beta$ with respect to the vertical surface perpendicular to the central axis of the shaft tube 10.

Then, the inclination angle $\alpha$ formed by the step-facing surface 5A of the grip member 5 is smaller than the inclination angle $\beta$ formed by the inclined step surface 12 of the shaft tube 10 when the grip member 5 is in an original natural state in which a compressive force along the axial direction of the shaft tube 10 is not applied to the grip member 5.

Figure 4A:
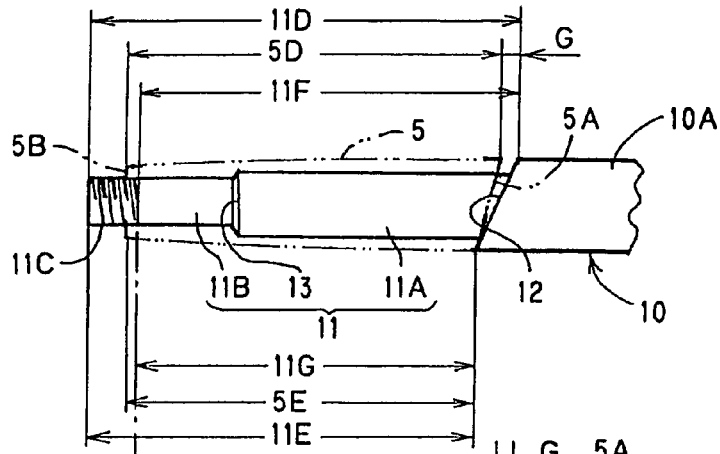
FIGS. 4(A) to 4(D) are enlarged side views showing different conditions of the main parts of the embodiment.
Figure 4B:
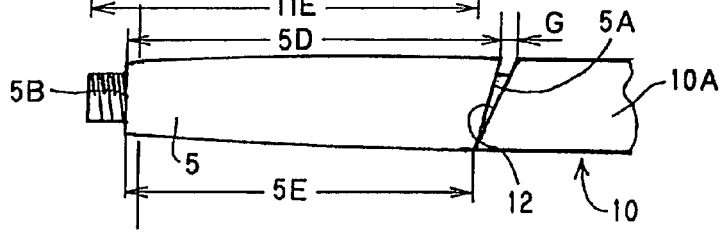

Moreover, since the step-facing surface 5A of the grip member 5 is inclined, as shown in FIGS. 4(A) and 4(B), there are formed a longest region 5D and a shortest region 5E, which have the longest length and the shortest length along the axial direction of the shaft tube 10, respectively. Further, in FIGS. 4(A) and 4(B), the longest region 5D is an uppermost region of the grip member 5, whereas shortest region 5E is a lowermost region of the grip member 5.

Similarly, since the inclined step surface 12 of the reduced-diameter portion 11 is inclined, as shown in FIG. 4(A) there are formed a longest region 11D and a shortest region 11E which have the longest length and the shortest length along the axial direction of the shaft tube 10, respectively. Further, in FIG. 4(A), the longest region 11D is an uppermost region of the reduced-diameter portion 11, whereas the shortest region 11E is a lowermost region of the reduced-diameter portion 11.

Figure 4C:
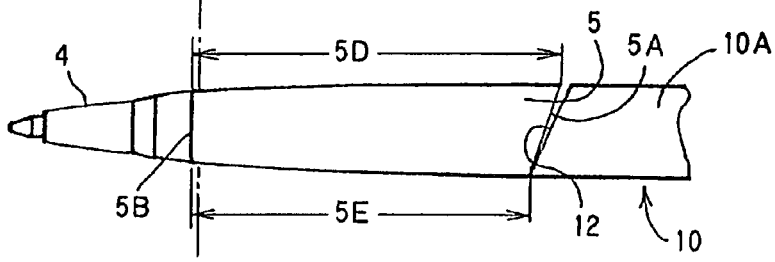
Figure 4D:
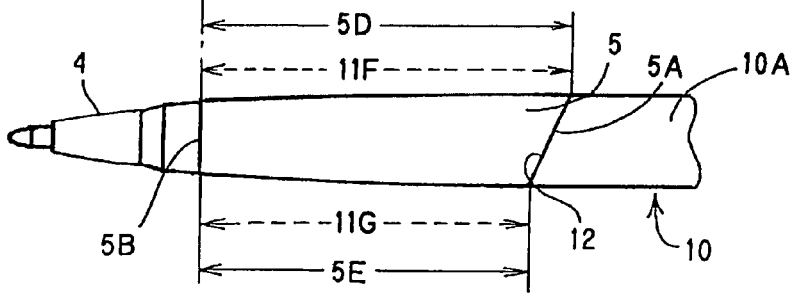

As shown in FIGS. 4(A) and 4(D), the reduced-diameter portion 11 has a longest covered portion 11F that is hidden by the grip member 5 on the longest region 11D side when the tip member 4 is fully screwed to the shaft-tube screw portion 11C. The length of longest covered portion 11F along the axial direction of the shaft tube 10 is the length of the longest region 11D other than the shaft-tube screw portion 11C.

Moreover, as shown in FIGS. 4(A) and 4(D), the reduced-diameter portion 11 has a shortest covered portion 11G that is hidden by the grip member 5 on the shortest region 11E side when the tip member 4 is fully screwed to the shaft-tube screw portion 11C. The length of the shortest covered portion 11G along the axial direction of the shaft tube 10 is the length of the shortest region 11E other than the shaft-tube screw portion 11C.

As described above, the longest region 5D of the grip member 5 has almost as long as the longest covered portion 11F of the reduced-diameter portion 11, whereas the shortest region 5E of the grip member 5 is longer than the shortest covered portion 11G of the reduced-diameter portion 11.

Accordingly, at least the shortest region 5E of the grip member 5 is so formed as to be compressed along the axial direction of the shaft tube 10 when the grip member 5 is disposed between the inclined step surface 12 of the reduced-diameter portion 11 and the tip member 4 and also when the tip member 4 is screwed to the shaft-tube screw portion 11C of the shaft tube 10.

As shown in FIG. 4(B), the gap G is generated as a compressible space between the end of the longest region 5D of the grip member 5 and the inclined step surface 12 of the reduced-diameter portion 11 when the grip member 5 is fitted to the reduced-diameter portion 11 in a non-compressed condition in which the grip member 5 is not compressed along the axial direction of the shaft tube 10, in other words, when the grip member 5 is merely fitted to the reduced-diameter portion 11 of the shaft tube 10.

Then, when the tip member 4 is screwed to the shaft-tube screw portion 11C of the shaft tube 10, the tip member 4 being gradually screwed to the shaft tube 10, the tip member 4 moves toward the grip member 5 as shown in FIG. 4(C) and a compressive force along the axial direction of the shaft tube 10 is automatically applied to at least the shortest region 5E as described above.

Accordingly, the tip end of the longest region 5D of the grip member 5, i.e., the acute-angled tip-end portion of the grip member 5, is so formed as not to come into contact with the step surface 12 of the shaft tube 10 until the grip member 5 is screwed to the tip member 4 to the shaft tube 10 to a certain degree.

Moreover, the shortest region 5E of the grip member 5 is so formed as to be applied with a compressive force by the tip-facing surface 5B and the end of the shortest region 5E at the inclined step surface 12 being depressed as the tip member 4 is gradually screwed to the shaft tube 10 even when the compressive force is not applied to the longest region 5D.

On the other hand, also in the interior of the grip member 5, the cone-shaped step surface 5C formed on the inner surface of the grip member 5 comes into contact with the cone-shaped step surface 13 of the shaft tube 10 and becomes depressed as the tip member 4 is gradually screwed to the shaft tube 10, as shown in FIG. 3(B), Accordingly, in the grip member 5, a compressive force is applied also to the part between the cone-shaped step surface 13 and the tip-facing surface 5B.

Then, the grip member 5, when compressed, receives a compressive force at the tip-facing surface 5B, the cone-shaped step surface 5C, and the end of the shortest region 5E at the inclined step surface 12.

In other words, lest the depressing force that depresses the grip member 5 toward the tip member 4 should concentrate to the end of the shortest region 5E at the inclined step surface 12, the cone-shaped step surface 5C is so formed as to receive the depressing force dispersedly.

Furthermore, as shown in FIG. 4(C), the acute-angled tip-end portion of the grip member 5 is so formed to approach the inclined step surface 12 of the shaft tube 10 as the tip member 4 is screwed to the shaft tube 10.

Then, the gap G formed between the acute-angled tip-end portion of the grip member 5 and the inclined step surface 12 is formed to disappear by the end of the longest region 5D of the grip member 5 and the inclined step surface 12 of the reduced-diameter portion 11 coming into contact with each other when the tip member 4 is fully screwed to the shaft tube 10, as shown in FIG. 4(D).

According to the embodiment described above, following advantages can be obtained.

That is, the step-facing surface 5A of the grip member 5 is inclined and the inclined step surface 12 of the shaft tube 10 opposed to the inclined step-facing surface 5A of this grip member 5 is also inclined. Thus, on the surface of the shaft tube 10, a boundary line between the grip member 5 and the shaft tube 10 extends obliquely with respect to the central axis of the shaft tube 10. As a result, excellent design can be imparted to the writing implement 1.

Moreover, the inclination angle $\alpha$ of the step-facing surface 5A of the grip member 5 is made smaller than the inclination angle $\beta$ of the inclined step surface 12 of the shaft tube 10. Thus, the whole of the acute-angled step-facing surface 5A of the grip member 5 does not come into contact with the inclined step surface 12 when a compressive force is not applied to the grip member 5 fitted to the reduced-diameter portion 11 of the shaft tube 10. In other words, in this condition, a gap G is partially formed between the step-facing surface 5A and the inclined step surface 12. More specifically, a gap G is formed between the acute-angled tip-end portion of the grip member 5 and the inclined step surface 12.

Further, the grip member 5 is applied a compressive force along the axial direction after being completely incorporated to the shaft tube 10 in order to improve the grasping feeling of the shaft tube 10 during use. Due to this compressive force, the step-facing surface 5A of the grip member 5 is depressed toward the inclined step surface 12 after the grip member 5 being completely incorporated to the shaft tube 10, and the whole of step-facing surface 5A comes into contact with the inclined step surface 12. Therefore, the gap G formed between the acute-angled tip-end portion of the grip member 5 and the inclined step surface 12 disappears, and the boundary line formed by the two members of different materials that constitute each of the grip member 5 and the shaft tube 10 extends obliquely. Thus, excellent design can be imparted to the writing implement 1.

Moreover, the whole of the step-facing surface 5A of the grip member 5 comes into contact with the inclined step surface 12 due to the compression of the grip member 5 after being incorporated to the shaft tube 10. Thus, even when the step-facing surface 5A of the grip member 5 is inclined, the acute-angled tip-end portion of the grip member 5, not moving along the inclined step surface 12, does not rise from the surface of the shaft tube 10. Accordingly, the problem can be solved that the tip-end portion of the grip member 5 becomes turned up to be damaged.

Therefore, excellent design can be imparted to the writing implement 1 due to the grip member 5 having an step-facing surface 5A inclined from a vertical surface perpendicular to the central axis of the shaft tube 10. In addition, the tip-end portion of the grip member 5 does not become turned up, and the grip member 5, not being turned up, cannot be damaged. Accordingly, even when the grip member 5 having an inclined end surface is adopted, the problems caused by the adoption of the grip member 5 can be solved. As a result of the foregoing, the above-described object can be achieved.

Moreover, the grip member 5 is disposed between the inclined step surface 12 of the reduced-diameter portion 11 and the tip member 4, and the tip member 4 is screwed to an end of the shaft tube 10. Thus, when the tip member 4 is screwed to the shaft tube 10, the tip member 4 moves toward the grip member 5. Accordingly, as the tip member 4 is screwed to shaft tube 10, a compressive force along the axial direction of the shaft tube 10 comes to be automatically applied to at least the shortest region SE of the grip member 5.

Therefore, until the tip member 4 is screwed to the shaft tube 10 to a certain degree, the longest region 5D of the grip member 5, i.e., the acute-angled tip-end portion of the grip member 5, does not come into contact with the inclined step surface 12 of the shaft tube 10. Accordingly, as the tip member 4 is screwed to shaft tube 10, a compressive force can be applied not to the longest region 5D but to the shortest region SE of the grip member 5.

Further, because a compressive force is applied to the shortest region 5E of the grip member 5, the grip member 5 prevents the tip member 4 screwed to the shaft tube 10 from rotating. Thus, even when the grip member 5 having the inclined step-facing surface 5A is adopted, the screwed tip member 4 does not become loose due to vibrations or the like. Accordingly, it is possible to prevent troubles, such as unexpected disengagement of the tip member 4. Moreover, a compressive force is not applied to the acute-angled tip-end portion of the grip member 5, and the tip-end portion is not strongly pushed against the step surface of the shaft tube 10 even when the compressive force is applied to the tip-end portion. Also in this respect, it is possible to previously prevent troubles such that the grip member 5 is apt to be broken.

Furthermore, the grip member 5 is formed in such a manner that, when fitted to the reduced-diameter portion 11 in a non-compressed condition in which the grip member 5 is not compressed along the axial direction of the shaft tube 10, a gap G as a compressible space is generated between the end of the longest region 5D and the inclined step surface 12 of the reduced-diameter portion 11. Therefore, when the tip member 4 is fully screwed to the end of the shaft tube 10, the end of the longest region 5D of the grip member 5 and the inclined step surface 12 of the reduced-diameter portion 11 come into contact with each other. Accordingly, that the gap G formed between the acute-angled tip-end portion of the grip member 5 and the inclined step surface 12 comes to be surely eliminated. In addition, it becomes possible to surely prevent the phenomenon that the acute-angled tip-end portion of the grip member S moves along the inclined step surface 12 and rises from the surface of the shaft tube 10. Therefore, also in this respect, even when the grip member S having the inclined step-facing surface 5A is adopted for imparting excellent design to the writing implement 1, it is possible to surely eliminate the troubles caused by the adoption of this grip member 5.

Moreover, a step is formed in the reduced-diameter portion 11 by providing a first reduced-diameter portion 11A and a second reduced-diameter portion 11B whose outside diameters are different from each other, a step surface at a boundary part between the first reduced-diameter portion 11A and the second reduced-diameter portion 11B is a cone-shaped step surface 13, a step corresponding to the reduced-diameter portion 11 is formed on an inner surface of the grip member 5, and the step surface formed in the step on the inner surface of the grip member 5 is a cone-shaped step surface 5C corresponding to the cone-shaped step surface 13 of the reduced-diameter portion 11. Thus the grip member 5, when compressed, can receive a depressing force with the cone-shaped step surface 5C. Accordingly, the depressing force that depresses the grip member 5 toward the tip member 4 is not concentrated on the end of the shortest region 5E on the inclined step surface 12, and the grip member 5 is prevented from being applied a concentrated large force. Also in this respect, even when the grip member 5 having the inclined step-facing surface 5A is adopted, it is possible to previously prevent troubles such that the grip member 5 is apt to be broken.

Moreover, the cone-shaped step surfaces 13, 5C that are formed in the shape of a circular truncated cone and correspond to each other are adopted both as the step surface in the boundary part between the first reduced-diameter portion 11A and the second reduced-diameter portion 11B, and as the step surface formed on the inner surface of the grip member 5. Thus, when the large depressing force that depresses the grip member 5 toward the inclined step surface 12 of the shaft tube 10 is applied to the grip member 5, the cone-shaped step surface 5C of the grip member 5 is guided to the cone-shaped step surface 13 of the reduced-diameter portion 11. Subsequently, in the part where the cone-shaped step surface 5C is formed, deformation occurs in such a manner that the grip member 5 spreads in the radial direction. According, it is possible to relieve this depressing force in the radial direction of the grip member 5.

Therefore, also in this respect, the depressing force that depresses the grip member 5 toward the tip member 4 is not concentrated to the end of the inclined step surface 12 of the shortest region 5E, and the grip member 5 is prevented from being applied a concentrated large force. Even when the grip member 5 having the inclined step-facing surface 5A is adopted, it is possible to previously prevent troubles such that the grip member 5 is apt to be broken.

Further, the present invention is not limited to the above-described embodiment and includes any modifications, improvements and the like as long as those enable the object of the present invention to be achieved.

For example, in the above-described embodiment, the shaft-tube screw portion formed in the shaft tube is a male thread and the tip-member screw portion formed in the tip member is a female thread. Conversely, however, it is possible to use a female thread in the shaft-tube screw portion and a male thread in the tip-member screw portion.

INDUSTRIAL APPLICABILITY

The writing implement of the present invention is not limited to the retractable ballpoint pen, but may be the capped ballpoint pen, and also the mechanical pencil, the felt-tip pen, the fountain pen and other kinds of writing implements. The present invention can be applied to writing implements in general that have forms for being supported in a sandwiched manner between fingers.

What is claimed is:

1. A writing implement comprising:

a shaft tube formed in a cylindrical shape, a reduced-diameter portion which is formed at an end of the shaft tube and has an outside diameter smaller than that of a remaining part of the shaft tube, and a cylindrical grip member made of flexible elastic material fitted to the reduced-diameter portion from the end of the shaft tube;

the shaft tube having a step so formed as to correspond to an end of the grip member, the step having a step surface opposing to the end of the grip member, the step surface being so formed as to be inclined with respect to a vertical plane perpendicular to a central axis of the shaft tube, the grip member having a step-facing surface opposing to the step surface, the step-facing surface being so formed as to be inclined with respect to the vertical plane perpendicular to the central axis of the shaft tube, and an inclination angle formed between the step-facing surface of the grip member and the vertical plane being smaller than that formed between the step surface of the shaft tube and the vertical plane when the step-facing surface of the grip member and the step surface of the shaft tube are inclined in the same direction with respect to the vertical plane.

2. The writing implement according to claim 1, further comprising:

a tip member covering an opening at the end of the shaft tube, a shaft-tube screw portion formed at the end of the shaft tube, a tip-member screw portion formed in the tip member;

the tip-member screw portion being so formed as to be screwed to the shaft-tube screw portion, the tip member being attached to the end of the shaft tube by the tip-member screw portion being screwed to shaft-tube screw portion, the grip member having a longest region and a shortest region along the axis of the shaft tube caused by the inclination of the step-facing surface, the reduced-diameter portion having a longest region and a shortest region along the axis of the shaft tube caused by the inclination of the step surface and also having a longest covered portion defined as a part of the longest region other than the shaft-tube screw portion and a shortest covered portion defined as a part of the shortest region other than the shaft-tube screw portion caused by the inclination of the step surface, the longest region of the grip member being almost as long as the longest covered portion of the reduced-diameter portion, the shortest region of the grip member being longer than the shortest covered portion of the reduced-diameter portion, the grip member being disposed between the step-surface of the reduced-diameter portion and the tip member, and the shortest region of the grip member being compressed along the axis of the shaft tube when the tip member is screwed to the end of the shaft tube.

3. The writing implement according to claim 2, the grip member being so formed to have a gap as a compressible space between its longest region and the step surface of the reduced-diameter portion when the grip member is fitted to the reduced-diameter portion not being compressed along the axis of the shaft tube, and the longest region of the grip member touching the step surface of the reduced-diameter portion when the tip member is fully screwed to the end of the shaft tube.

4. The writing implement according to claim 3, the reduced-diameter portion having a first reduced-diameter portion and a second reduced-diameter portion with different outside diameters from each other, the first reduced-diameter portion provided at a far end from the tip portion being formed thinner than the second reduced-diameter portion at another end, a step surface formed by a step in a boundary between the first reduced-diameter portion and the second reduced-diameter portion being a cone-shaped step surface formed in a shape of a circular truncated cone coaxial with the central axis of the shaft tube, and the grip member having a cone-shaped step surface formed in its inner surface corresponding to the cone-shaped step surface of the reduced-diameter portion by the inner surface being reduced correspondingly to the reduced-diameter portion.

* * * * *